US006709295B2

(12) United States Patent
Givens et al.

(10) Patent No.: US 6,709,295 B2
(45) Date of Patent: Mar. 23, 2004

(54) CONNECTOR ASSEMBLY

(75) Inventors: David F. Givens, Harrisburg, PA (US); Leonard K. Espenshade, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 240 days.

(21) Appl. No.: 10/036,073

(22) Filed: Oct. 19, 2001

(65) Prior Publication Data

US 2003/0077942 A1 Apr. 24, 2003

(51) Int. Cl.[7] ..... H01R 13/66
(52) U.S. Cl. ..... 439/620
(58) Field of Search ..... 439/541.5, 620, 439/676, 607, 609, 490

(56) References Cited

U.S. PATENT DOCUMENTS 5,139,442 A * 8/1992 Sakamoto et al. ..... 439/620
5,587,884 A * 12/1996 Raman ..... 439/620
5,647,767 A * 7/1997 Scheer et al. ..... 439/620
5,687,233 A * 11/1997 Loudermilk et al. ..... 439/676
6,022,245 A * 2/2000 Minich ..... 439/620
6,193,560 B1 * 2/2001 Morana et al. ..... 439/541.5
6,283,786 B1 * 9/2001 Margulis et al. ..... 439/490

* cited by examiner

*Primary Examiner*—Gary Paumen
(74) *Attorney, Agent, or Firm*—Wei Te Chung

(57) ABSTRACT

A connector assembly (1) mounted on a printed circuit board for mating with a network cable includes a housing (12) configured to form two mating ports (10) for receiving their complementary connectors. A conditioning unit (2) is mounted into the housing (12) to be disposed between the mating ports (10), and includes a circuit board (21) having conditioning components (22) and two terminal modules (23, 24) surface mounted thereon. Each of the terminal modules (23, 24) has terminals (25) insert-molded therein and is mounted on a different side of the circuit board (21) from each other. At least one flexible latch (18) is formed on the middle portion of one sidewall of the housing (12) and a notch (28) is formed at one edge of the circuit board (21) to be engaged with the latch (18) to fix the conditioning unit (2) in position. Thus, the conditional unit (2) is easily secured to the housing (12) and the latch (18) is easily detached from the notch (28) by a tool.

13 Claims, 8 Drawing Sheets

CONNECTOR ASSEMBLY

BACKGROUND OF THE INVENTION

1. Field of the Invention

The present invention is related to a connector assembly of modular jacks, especially to a connector assembly having a conditioning unit including a circuit board with magnetic filter/conditioning components mounted on it to condition the signals passing through them.

2. Description of the Related Art

The communication between computers becomes more and more important because of the prevalence of the Internet. People use the Internet or an internal network everyday for their daily work, entertainment, and other personal affairs. However, for each of personal computers or end-user terminals, a mutual intermediary like cables or wires is necessary to connect these computers into a network. The signal transmission speed in such a network depends on the conductivity of the cables, the operation speed of the workstations or servers signal transmitting, and the condition of the environment in which computers and cables are located. Usually the signals transmitted by cables are easily affected because of the diversity and unpredictability of the environment cables meet. Therefore, if signals can be conditioned before they are transmitted, received or used by any electronic device, the performance and working speed of this device will be better and faster. The best way to avoid any noise interference is shielding the cable and device all the time. However, in high frequency and speed situation, any necessary connection is always a deficiency to cause signals interfered by an outer noise source and failing to achieve the perfect transmission. And the cost for a perfect electrical shield is expensive too. Besides, crosstalk always happens between two parallel signal-transmitting conductors. Thus, the signals transmitted by cables or wires should be conditioned first before they are used in any electrical device like computers due to their noise problem. Especially, to mount a conditioning component, such as a common mode choke coil, filter circuit or transformer, into any I/O connector of these devices is a good way because the I/O connector is always the last or important one of the necessary connections should be well shielded for a perfect transmission. Sakamoto et al. U.S. Pat. No. 5,139,442 introduces such a modular jack connector having a built-in common-mode choke coil. However, to use wires of the coil as contactors of the modular jack connector cause more complicated assembling process always costs high and is time-consuming. Therefore U.S. Pat. No. 5,687,233 issued to Loudermilk et al. discloses a built-in printed board containing a noise suppressing electronic element like transformer is received in the modular jack connector. It is obviously laborsaving because the contactors of the connector are mounted to the printed board after the filter circuit and related electronic elements are mounted onto the printed board in advance. And more signal contactors can be used and assembled at the same time by increasing necessary number of the electronic elements and their corresponding circuits on the board beforehand.

The method adopted in Loudermilk et al. needs to be improved due to the expensive cost to produce its built-in printed board and still complicated process to assemble the printed board and the connector housing. Especially the isolated contactors of the connector should be well sustained when they are assembled into the connector housing together with the printed board. And in the multi-port application, the increasing contactors need to be mounted onto the motherboard will make it much more difficult to dispose or assemble the built-in printed board. U.S. Pat. Nos. 5,587,884 and 5,647,767 disclose a subassembly inserted into the housing of the modular jack connector. The subassembly includes a front insert member having contact terminals and a rear insert member having a printed board with conditioning components mounted thereon. Better support from these two insert members will effectively sustain the terminals and other components when the subassembly is inserted into the connector housing and fastened therein during the assembling process. However, much more procedures are needed to manufacture the subassembly and most of them like insert-molded parts cost expensively. Besides, new parts are needed in the multi-port application. Minich U.S. Pat. No. 6,022,245 shows a modular connector having two stack plug receiving ports. Two retainers holding terminals in the connector housing and a printed board having filter components and an edge connector to connect the printed board to the motherboard where the modular connector is seated. After the retainers and terminals are properly installed into the housing, the printed circuit board is installed into the housing and ends of terminals make resilient contact to the printed board. Installing support to every terminal is enough again and the simplified process will be adopted to produce each of necessary parts. However, in this case, too many parts are needed and the assembling process is still complicated and labor consuming. And more fixture mechanism in the housing is needed to put each of these parts in position.

In conclusion, it is understandable that most of methods adopted by these prior arts mentioned above have a complicated process, especially when assembling. Meanwhile, it is difficult to dismantle parts if some of them fail to work. Some of parts disclosed in prior art are vulnerable when removing from the housing. That means it is impossible to rework or repair on them if some of them need to change. Furthermore, no parts in prior art can be used in another product applications having a different number of mating ports.

SUMMARY OF THE INVENTION

Therefore, an object of the present invention is to provide a connector assembly having simplified parts to assemble to each other and be detachable easily.

Another object of the present invention is to provide a connector assembly that can be fitted together very conveniently and quickly to shorten and simplify the manufacturing process for timesaving and costdown.

Another object of the present invention is to provide-a-connector assembly with a large number of necessary integrated components which are accessible to rework or repair by detaching them easily rather than costly disposal of the whole connector assembly.

The other object of the present invention is to provide a multi-port connector assembly with each mating port having their own integral components. These components can be integrated to assemble and affix to the connector assembly by easily fixing attachment.

A further object of the present invention is to provide same parts which can be used for at least two kinds of the connector assembly having a different number of mating ports from others and is not in need of producing any additional new parts for another new port-numbered application.

To obtain the above objects, a connector assembly including a housing configured to form two mating ports for receiving their own complementary connectors is formed. A conditioning unit is mounted into the housing and disposed between the mating ports. The conditioning unit includes a circuit board having conditioning components and two terminal modules surface mounted thereon. Each of the terminal modules has terminals insert-molded therein and is mounted on one side of the circuit board to make one end of their terminals being exposed inside one of the corresponding mating ports separately.

Specifically, at least one flexible latch is formed on the middle portion of one sidewall of the housing. At one edge of the circuit board, a notch is formed corresponding to the latch of the housing. When assembling, the conditioning unit is inserted into the housing and the edge of the circuit board is snug in a guiding groove formed on the inward side of the sidewall and the latch is then engaged with its corresponding notch to fix the unit in position. For such an arrangement, the conditional unit is easily secured to the housing and finally settled between two mating ports to ease the assembly of two terminal modules for each mating port. And the latch is easily detached from the notch of the circuit board by hands or a tool to simplify any rework or repair process.

Other objects, advantages and novel features of the invention will become more apparent from the following detailed description of the present embodiment when taken in conjunction with the accompanying drawings.

DESCRIPTION OF THE PREFERRED EMBODIMENT

Figure 1:
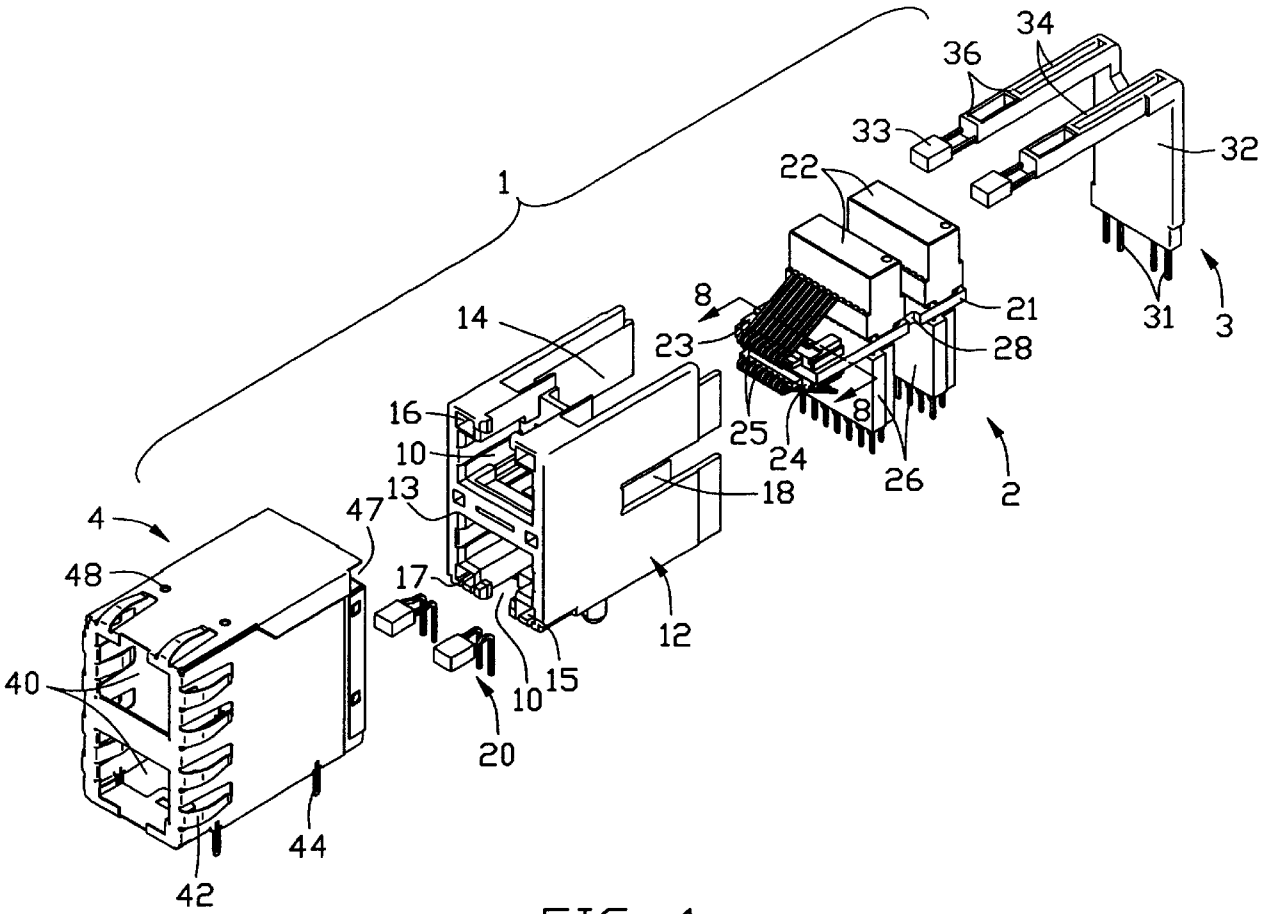
FIG. 1 is an exploded view of a connector assembly in accordance with the present invention.
Figure 2:
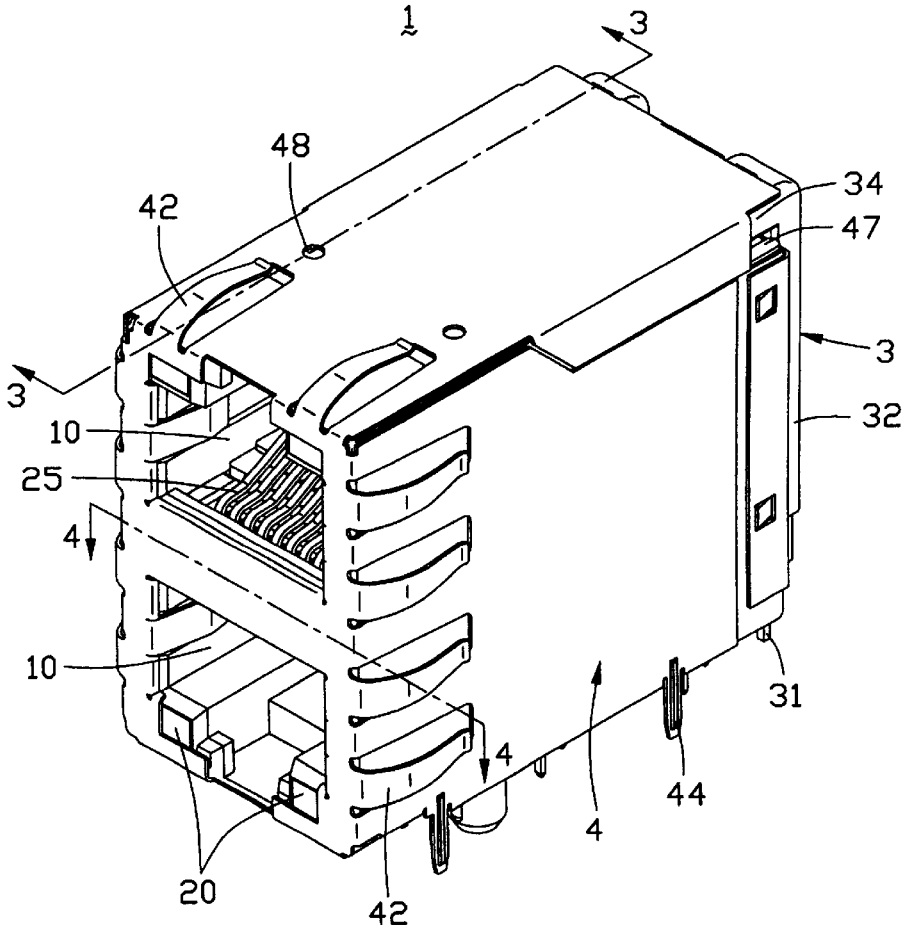
FIG. 2 is an assembled perspective view of the connector assembly of the present invention.

Referring to FIGS. 1 and 2, the present invention is related to a connector assembly 1 and is shown to include at least two stacked and mirror-arranged modular jack mating ports 10 each connecting to a network cable (not shown) and transmitting signals between the cable and a printed circuit board (PCB, not shown) where the connector assembly 1 is seated and mounted. A housing 12 is configured to provide these two mating ports and define two vertically arranged spaces each of which is next to one of the ports to receive a mating plug of the corresponding network cable. Another receiving space 14 is formed within the rear portion of the housing 12 and communicating with each space of two mating ports 10 by channels formed on a partition wall (not shown) between them. At the front wall 13 of the housing 12, four holes 15, 16 are disposed at each comer of the front wall 13. Each of two lower holes 15, near the PCB mounting side of the front wall 13, extends into the housing 12 from the front wall 13 for a suitable depth to receive a standard single LED 20 inside it. Each LED 20 is inserted into the corresponding lower hole 15 by first having its right-angled legs crossing and moving along slits 17 formed on the bottom sidewall of every lower hole 15. Each of two upper holes 16 is perforated into the housing 12 from the front wall 13 of the housing 12 to the receiving space 14. A flexible latch 18 is formed on the middle portion of every sidewall of the housing 12.

Figure 8:
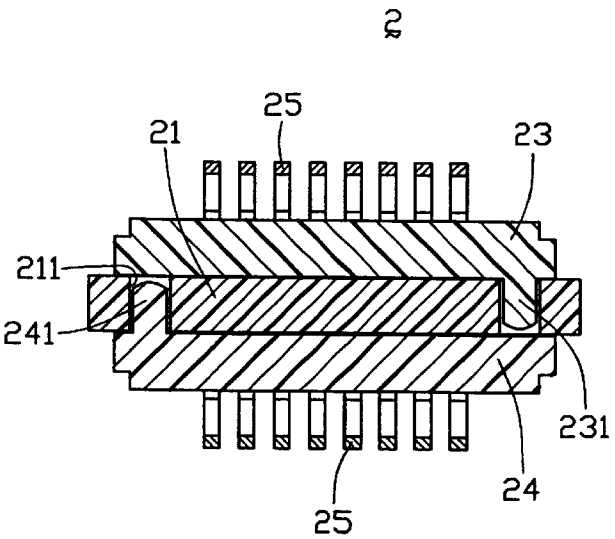
FIG. 8 is a sectional view of the conditioning unit shown in FIG. 1 along the 8—8 line showing the terminal modules mounted onto the circuit board of the conditioning unit.
Figure 7:
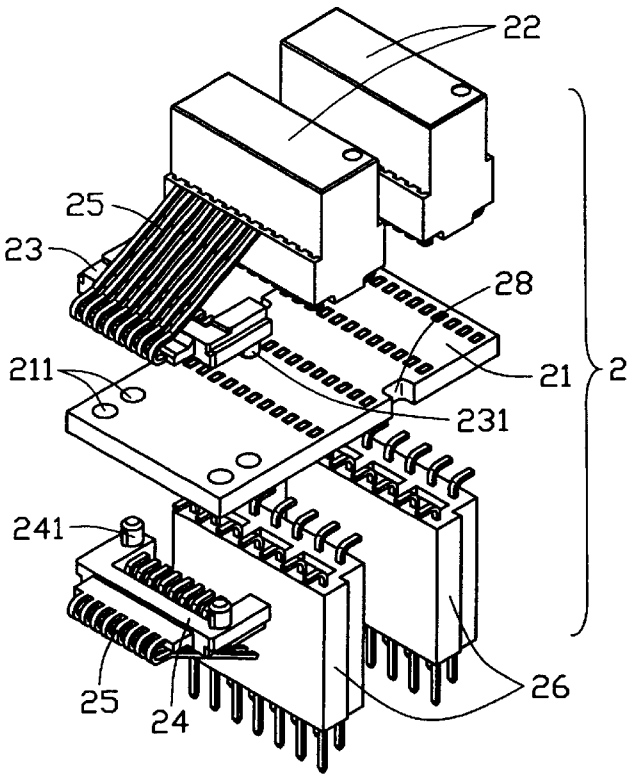
FIG. 7 is an exploded view of the conditioning unit shown in FIG. 1.

Referring to FIGS. 1 and 7, a conditioning unit 2 is mounted into the receiving space 14 and located in a plane defined perpendicular to the front wall 13 and the sidewalls of the housing 12. The conditioning unit 2 includes a circuit board 21 with conductive traces (not shown) on it. At least two sets of magnetic filtering/conditioning components 22 corresponding to the mating ports 10 are surface mounted on the circuit board 21 to condition the signals passing through them. Two sets of terminals 25 are respectively insert-molded into an upper and lower terminal module 23, 24 and are separately surface mounted on the two sides of the circuit board 21 near a leading edge (not labeled) thereof. Two posts 231, 241 are extended from the mounting side of each terminal module 23, 24 and are staggered for their positions by two imaginary midlines along both of the longitudinal and transverse directions of these two terminal modules 23, 24 respectively. Every post 231 of the upper terminal module 23 are alternately aligned with one post 241 of the lower terminal module 24 when these posts 231, 241 are inserted into four corresponding hole 211 formed on the circuit board 21 respectively for guiding and temporarily fixing terminal modules 23, 24 when they are surface mounted onto the circuit board 21 (referring to FIG. 8). At least two tail modules 26 corresponding to the terminal modules 23, 24 respectively are formed and surface mounted on the lower side of the circuit board 21. One end of every tail module 26 has tails being surface mounted on the circuit board 21 and the other end has tails connecting to the PCB the connector assembly 1 is seated. At each of two opposite side edges adjacent to the leading edge of the circuit board 21, a notch 28 is formed corresponding to every latch 18 of the housing 12.

A LED module 3 having two standard LEDs insert-molded integrally is mounted to the connector assembly 1. The LED module 3 has a base portion 32 with legs 31 of LEDs extending in it and two branch portions 34 right-angled extending from the base portion 32. At the end of each branch portion 34 the light-emitting body 33 of the standard LED is disposed. Ribs 36 are formed on the middle section of every branch portion 34. Each of branch portions 34 of the LED module 3 passes through the receiving space 14 of the housing 12 and is inserted into a corresponding upper hole 16 when assembling. The light-emitting body 33 of the LED is then visible at the front side 13 of the housing 12. In addition, an outer shell 4 is disposed to enclose the housing 12. Two mirror-shaped hollows 40 corresponding to the mating ports 10 are formed on the front plate of the outer shell 4 and a plurality of fingers 42 cut from the portions of the top plate and two opposite side plates abutting against the front plate are bent away from the plates and are extending rearward from edges of the front plate. Legs 44, usually grounded, are formed on the bottom edges of two side plates. The rear plate, as an extending portion of the top plate before assembling, is bent downward after the housing 12 is positioned into a space formed inside the outer shell 4 and engaged with two side plates on their adjacent edges. Two recesses 47 on the rear plate are formed abutting against the top plate and each is aligned with one of the upper holes 16 after assembling.

Figure 3:
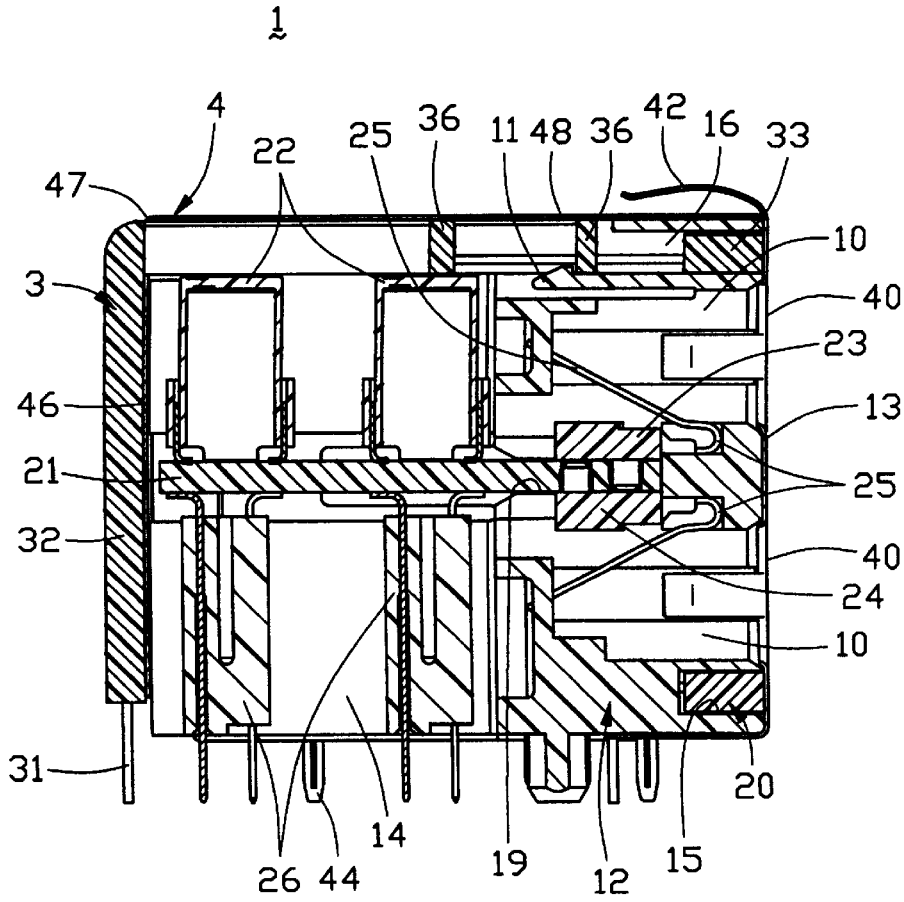
FIG. 3 is a sectional view of the connector assembly showing a conditioning unit including surface mount filter components and terminal modules along the 3—3 line in FIG. 2.
Figure 4:
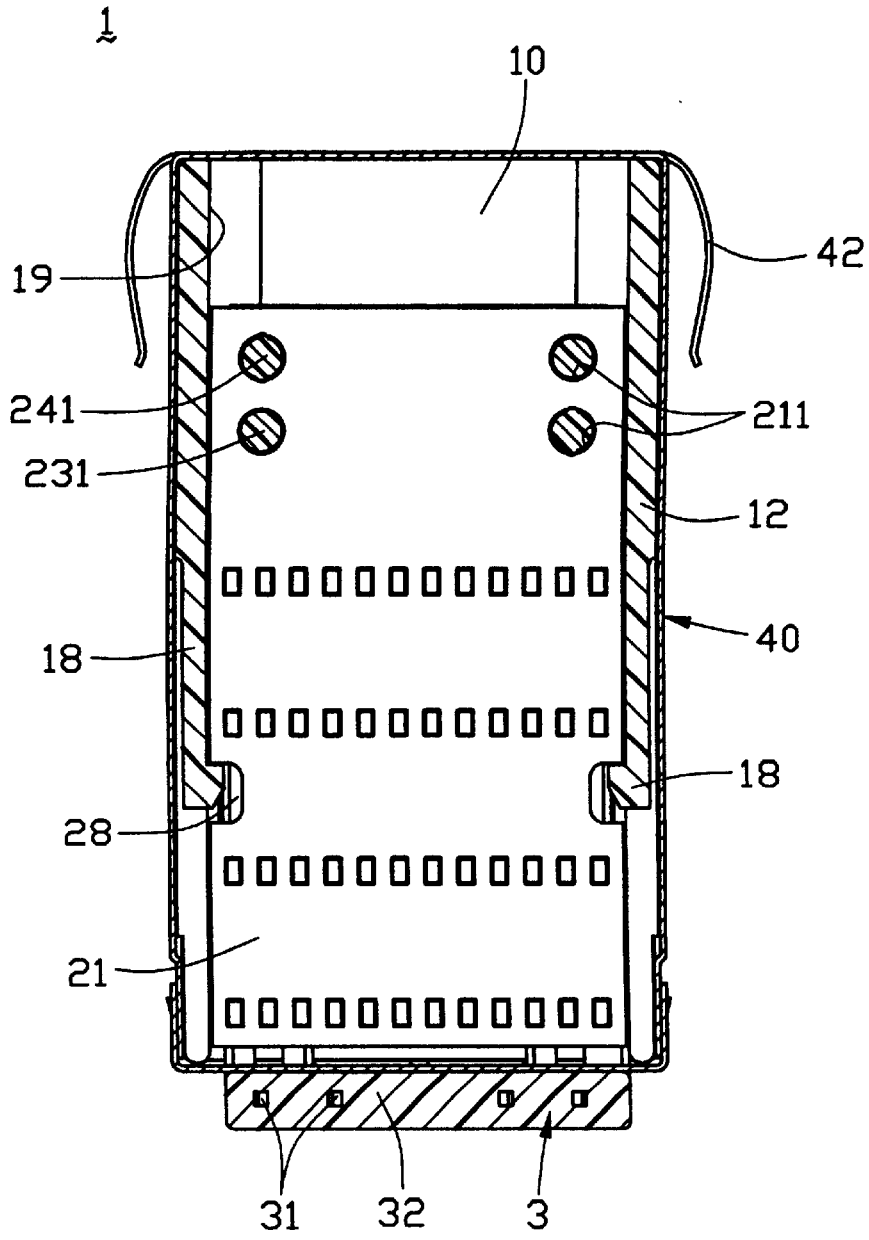
FIG. 4 is a sectional view of the connector assembly showing a conditioning unit fixed by latches formed on the housing along the 4—4 line in FIG. 2.
Figure 6:
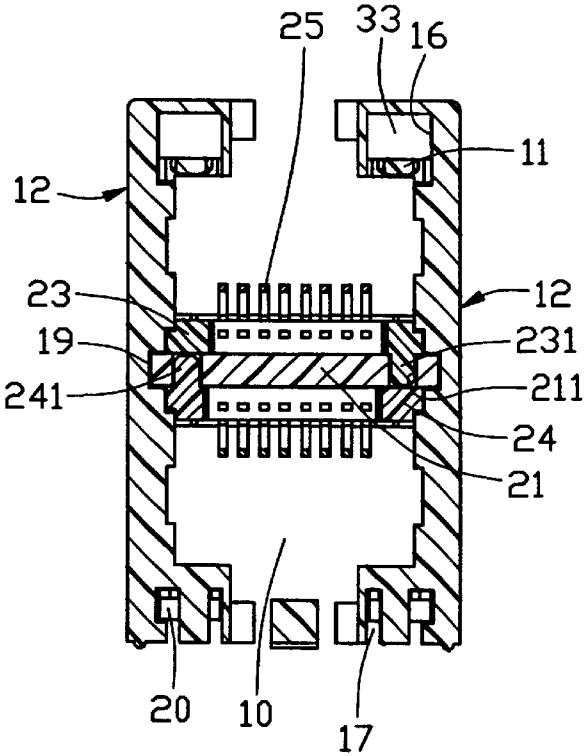
FIG. 6 is a sectional view of the subassembly shown in FIG. 5 along the 6—6 line showing guiding grooves in the housing to receive the conditioning unit.
Figure 5:
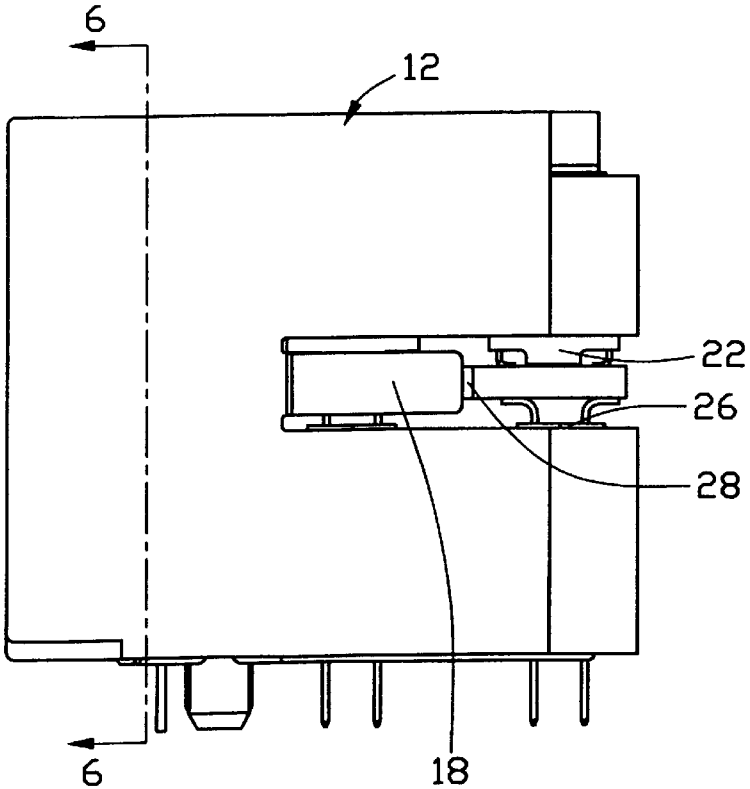
FIG. 5 is a side view of a subassembly of the housing and conditioning unit by dismantling the outer shell off.

Referring particularly to FIGS. 3 and 6, the conditioning unit 2, when assembling, is first inserted into the receiving space 14 by having two opposite side edges of the circuit board 21 snug in guiding grooves 19 formed on the inward side of the sidewall of the housing 12 and sliding the whole unit 2 into the receiving space 14. Each of the latches 18 of the housing 12 is then engaged with its corresponding notch 28 of the circuit board 21 to fix the unit 2 in position when the leading edge of the circuit board 21 reaches to the rearward side of the front wall 13. A subassembly (not labeled) is formed then (referring to FIGS. 4 and 5 at the same time). After the LEDs 20 are engaged within the lower hole 15 of the housing 12, the housing 12 is then enclosed by the outer shell 4. The branch portions 34 of the LED module 3 are then penetrated into the recesses 47 of the outer shell 4 and mounted onto the connector assembly (as shown in FIG. 2). Furthermore, a flexible locking arm 11 is formed on the bottom sidewall of every upper hole 16 and is extending rearward into the receiving space 14. An aperture 48 is formed on the top plate of the outer shell 4 corresponding to every locking arm 11 and is right above the locking end of every arm 11 to provide an accessible path toward the locking end. It is understandable that, when assembling, each of the branch portions 34 of the LED module 3 is moved along a passage automatically formed between the recess 47 on the outer shell 4 and the upper hole 16 by part of the receiving space 14 and is then latched when one of the ribs 36 on the branch portion 34 moves to be engaged with the locking end of the arm 11 in Referring to FIGS. 4, 5 and 6, it is understandable, the conditional unit 2 is easily secured to the housing 12 after sliding along the guiding grooves 19. It is because the latches 18 are disposed along the same orientation as the sliding direction of the conditioning unit 2. Besides, the circuit board 21 of the conditioning unit 2 is finally settled in the middle portion of receiving space 14 in the housing 12. It is convenient to further dispose or assemble terminal modules 23, 24 for each mating port 10 in the housing 12 due to the symmetric arrangement. And upper and lower terminal module 23, 24 can be made the same due to such a symmetric arrangement too. Further electronic parts like filtering components 22 and tail modules 26 can be easily mounted onto the circuit board 21 if they can be symmetrically disposed onto the circuit board 21 too. That means the possibility of space saving for the connector assembly 1 and a compact size that the connector assembly 1 can be. The latches 18, as shown in FIGS. 1 and 5, are easily detached from the notch 28 of the circuit board 21 by hands or a tool for a shell-unenclosed housing 12. Any rework or repair process will be simplified and timesaving due to the fast-release design.

Figure 9:
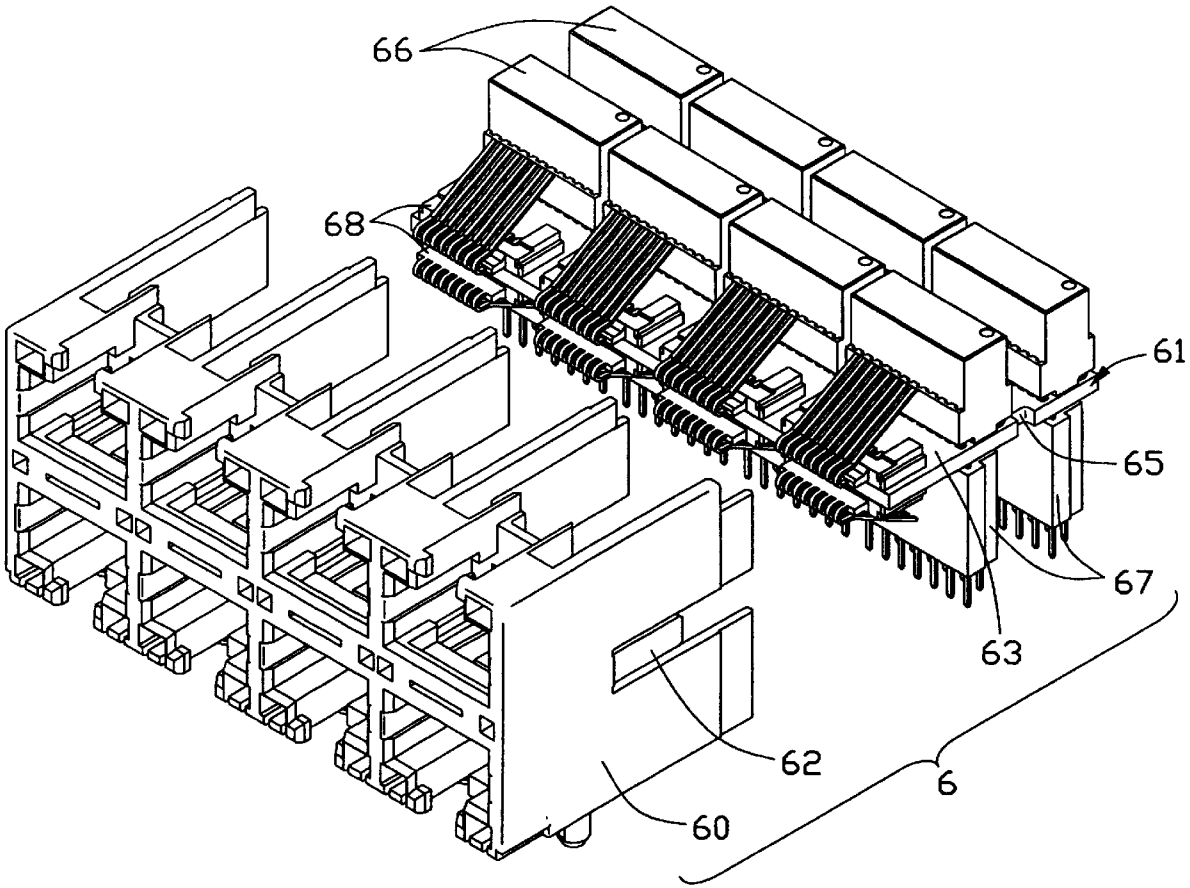
FIG. 9 is an explosive view of a subassembly of a multi-port connector assembly in accordance with the present invention, showing an integral conditioning unit to be inserted into the housing.

Referring to FIG. 9, an unshielded subassembly 6 of a connector assembly with multi ports is shown. An integral unshielded housing 60 is formed to put all ports together in two-rowed side-by-side arrangement. A conditioning unit 61 with a common circuit board 63 is inserted into a mutual receiving space (not shown) in the rear portion of the housing 60 by having two opposite side edges of the circuit board 61 snug in two guiding grooves (not shown) formed on the inward side of the sidewall of the housing 60. A flexible latch 62 is formed on the middle portion of every sidewall of the housing 60 and can be engaged with a corresponding notch 65 formed on a side edge of the circuit board 63. A magnetic filtering/conditioning component set 66 and tail module 67 corresponding to each of the mating ports are surface mounted on the upper and lower sides of the circuit board 63 respectively. Pairs of Terminal modules 68 each has two modules to be inversely surface mounted on the two sides of the circuit board 63 near a leading edge (not labeled) thereof are arranged in two side-by-side rows in accordance with the mating ports. Effective costdown will take place by sharing the same parts like terminal modules 68 to make different optional jack assembly. And fast and easily assembling process for this integral conditioning unit 61 fixed by the latch 62 is again very convenient to remove. It is understandable, however, to provide a multi-port connector assembly with pairs of upper and lower mating ports having their own separately conditioning unit that is same as the first embodiment in accordance with the present invention. More partition inner walls and latches formed on them should be available in such an application.

Figure 10:
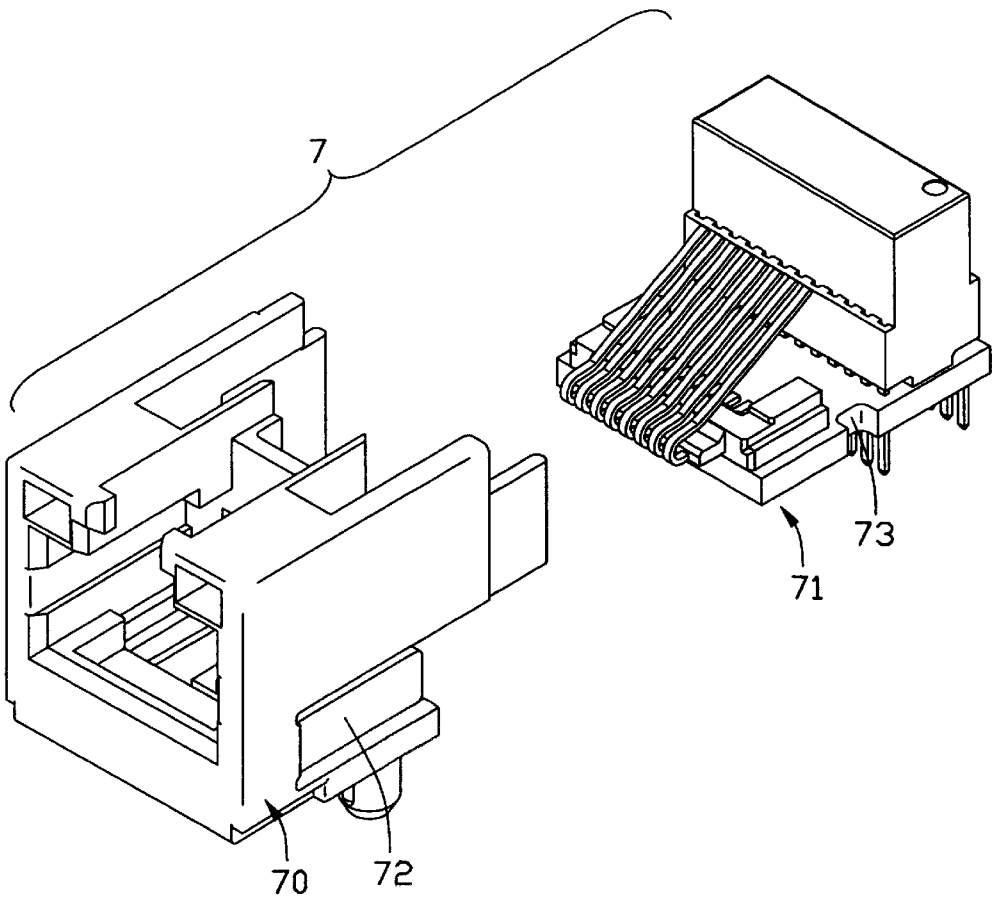
FIG 10 is an explosive view of a subassembly of a single-port connector assembly in accordance with the present invention, showing the conditioning unit to be inserted into the housing.

Referring to FIG. 10, a third embodiment in accordance with the present invention is suggested to provide a single mating port of a module jack 7. Same parts used for the former embodiment can be adopted again to make the conditioning unit 71 of this modular jack 7. Two latches 72 are formed on the unshielded housing 70 of this modular jack 7 and are engaged with a notch 73 formed on the edge of the conditioning unit 71 to position it.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A connector assembly comprising:

a housing defining at least one mating port for receiving a complementary connector;

a unit with a circuit board having a conditioning component disposed thereon including a plurality of terminals installed on one side thereof and exposed into the at least one mating port for electrical engaging with the complementary connector, said circuit board further comprising a notch formed on one edge of said circuit board; and means being formed on a sidewall of the housing to releasably clasp said unit by engaging with the notch when the edge of said unit moves along the sidewall and being approachable from outside of the housing to disengage from said unit when needed.

2. The connector assembly as recited in claim 1, wherein said means comprises a latch formed on the sidewall, and said latch is flexible and extending along one edge of said unit.

3. The connector assembly as recited in claim 2, wherein at least one guiding groove is formed on an inward sidewall of the housing to help positioning the unit with respect to said latch.

4. The connector assembly as recited in claim 1, wherein the connector assembly comprises even mating ports and every two of them are stacked in the normal direction of a primary printed circuit board where the connector assembly is seated, and said unit is disposed between said every two mating ports and two sets of said terminals are inversely received in said every two mating ports respectively.

5. The connector assembly as recited in claim 1, wherein a tail module is used to connect said unit to a primary printed circuit board where the connector assembly is seated.

6. The connector assembly as recited in claim 1, wherein the connector assembly further comprises an outer,shell to enclose the housing.

7. The connector assembly as recited in claim 6, wherein the connector assembly further comprises an LED module insert-molded with at least one LED therein to be disposed as a visible indicator of the corresponding mating port.

8. The connector assembly as recited in claim 7, wherein at least one recess is formed on the outer shell for a portion of the LED module to pass through and a passage is defined in the housing to receive said portion.

9. A connector assembly comprising:

a housing being adapted to be seated on a printed circuit board and defining at least one mating port for receiving a complementary connector;

a unit having a circuit board with a conditioning component disposed thereon and being disposed along a plane defined beside the mating port and perpendicular to the receiving interface of the housing, a plurality of terminals being mounted on said unit and each extending its two ends to connect the printed circuit board to the complementary connector, said circuit board further comprising a notch formed on one edge of said circuit board; and means being formed and extending along a second plane defined in the housing perpendicular to said plane where the unit is located to hold the unit in position inside the housing by engaging with the notch when the edge of said unit moves along said plane, said means being removable from the unit by a tool applying a removing force thereon along the second plane.

10. The connector assembly as recited in claim 9, wherein the second plane is located on a sidewall of the housing.

11. The connector assembly as recited in claim 10, wherein said means comprises a flexible latch formed on the sidewall to extend along one edge of said unit.

12. The connector assembly as recited in claim 9, wherein the connector assembly comprises even mating ports and every two of them are stacked along the second plane direction, and said unit is disposed between said two mating ports and two sets of said terminals are inversely received in said two mating ports respectively.

13. A multi-port connector assembly comprising:

an integral housing including an even number of mating ports arranged in two rows to receive corresponding mating connectors, and at least one latch being formed at one side of at least two mating ports arranged in said two different rows and disposed between them;

at least one unit having a circuit board with a conditioning component and a plurality of terminals disposed thereon, said circuit board further comprising a notch formed on one edge of said circuit board, said unit being received in the housing between said two mating port rows and being latched on the notch of the circuit board by the at least one latch; wherein the at least one latch being approachable for an external tool along the side where the at least one latch is formed.

* * * * *